US010140963B2

(12) United States Patent
Klanner

(10) Patent No.: US 10,140,963 B2
(45) Date of Patent: Nov. 27, 2018

(54) MUSICAL STRING

(71) Applicant: Thomastik-Infeld Gesellschaft m.b.H., Vienna (AT)

(72) Inventor: Franz Klanner, Vienna (AT)

(73) Assignee: THOMASTIK-INFELD GESELLSCHAFT M.B.H., Vienna (AT)

( * ) Notice: Subject to any disclaimer, the term of this patent is extended or adjusted under 35 U.S.C. 154(b) by 0 days.

(21) Appl. No.: 15/490,177

(22) Filed: Apr. 18, 2017

(65) Prior Publication Data

US 2017/0301322 A1 Oct. 19, 2017

(30) Foreign Application Priority Data

Apr. 18, 2016 (AT) ..... A 50344/2016

(51) Int. Cl.
*G10D 3/10* (2006.01)

(52) U.S. Cl.
CPC ..... *G10D 3/10* (2013.01)

(58) Field of Classification Search
CPC ..... G10D 3/10; G10D 3/12
See application file for complete search history.

(56) References Cited

U.S. PATENT DOCUMENTS

| | | | | |
|---|---|---|---|---|
| 4,929,503 | A | 5/1990 | Shirasaki et al. | |
| 2010/0071529 | A1 | 3/2010 | Infeld | |
| 2015/0248876 | A1* | 9/2015 | Tao | G10D 3/10 84/297 S |

FOREIGN PATENT DOCUMENTS

| | | | |
|---|---|---|---|
| AT | 506 135 | | 6/2009 |
| DE | 3619447 | A * | 12/1986 |
| DE | 197 54 606 | | 6/1998 |
| EP | 2 099 022 | | 9/2009 |
| EP | 2 131 352 | A1 | 12/2009 |
| WO | WO 2009/039538 | | 4/2009 |

OTHER PUBLICATIONS

European Search Report dated Aug. 14, 2017 with respect to counterpart European patent application EP 17 16 6049.
Translation of European Search Report dated Aug. 14, 2017 with respect to counterpart European patent application EP 17 16 6049.
Austrian Search Report dated Oct. 24, 2016.
English translation of Austrian Search Report dated Oct. 24, 2016.

* cited by examiner

*Primary Examiner* — Kimberly Lockett
(74) *Attorney, Agent, or Firm* — Henry M. Feiereisen LLC

(57) ABSTRACT

A musical string, in particular for a string instrument, includes at least one load-bearing string core, said string core having plastic threads, said plastic threads including a first group of first plastic threads and a second group of second plastic threads, wherein the first plastic threads differ from the second plastic threads with respect to a predeterminable physical property.

37 Claims, 3 Drawing Sheets

MUSICAL STRING

CROSS-REFERENCES TO RELATED APPLICATIONS

This application claims the priority of Austrian Patent Application, Serial No. A 50344/2016, filed Apr. 18, 2016, pursuant to 35 U.S.C. 119(a)-(d), the content of which is incorporated herein by reference in its entirety as if fully set forth herein.

BACKGROUND OF THE INVENTION

The invention relates to a musical string.

The following discussion of related art is provided to assist the reader in understanding the advantages of the invention, and is not to be construed as an admission that this related art is prior art to this invention.

Musical strings have a string core, which absorbs the tension of the musical string. Usually musical strings also have a winding, which forms a mass layer which however does not carry string tension.

It is known to make a string core of a musical string either from a metal wire or metal wires, from animal intestine or from synthetic fibers. The different configurations of musical strings have advantages depending on the used raw material and the purpose of application. Regarding the sound quality and the capability to produce musical strings with most identical properties, in particular synthetic fibers or synthetic threads have proven useful as material for a string core of a musical string.

Like all musical strings also musical strings with a string core made of synthetic threads will age during operation. Hereby the musical strings change their sound characteristics and their response over the time period over which the musician plays the respective strings, usually in an adverse manner until the musician is no longer satisfied with the respective musical string and replaces the musical string.

In modern musical strings with synthetic core oftentimes high-performance plastics are used which are correspondingly difficult to produce and expensive. Hereby the type of plastic used has a significant effect on the sound characteristics of the musical string. The frequent replacement of the musical strings can be associated with significant costs for the musician and in addition adversely impacts the environment.

It would therefore be desirable and advantageous to provide a musical string with which the mentioned disadvantages can be avoided and which has a balanced sound and a long service life.

SUMMARY OF THE INVENTION

According to one aspect of the present invention a musical string, in particular for a string instrument, includes at least one load-bearing string core, said string core having plastic threads, said plastic threads including a first group of first plastic threads and a second group of second plastic threads, wherein the first plastic threads differ from the second plastic threads with respect to a predeterminable physical property.

This allows generating a musical string, which has an increased service life. Furthermore a musical string can be created which has a good sound and a good response over a long period of time, in particular when excited by stroking with a bow. The two groups of plastic threads, which differ in their properties, allow balancing out or compensating a behavior of one plastic by a behavior of the other plastic. This also allows achieving a particularly balanced sound.

The dependent claims relate to further advantageous embodiments of the invention. Reference is hereby expressly made to the wording of the claims, whereby the claims are incorporated into the description at this point by reference and are considered to be reproduced verbatim.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
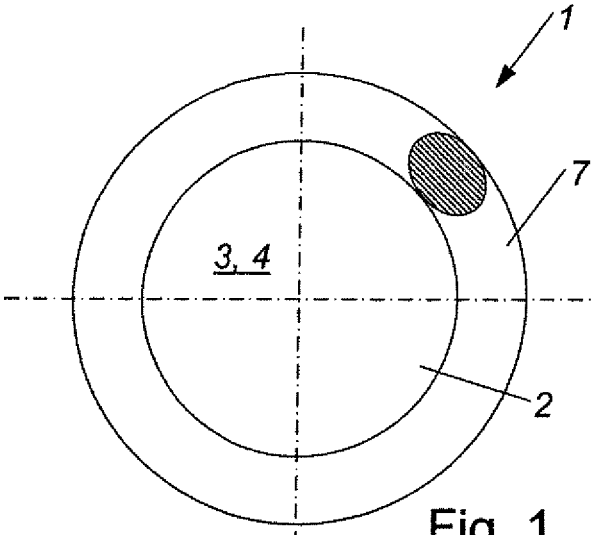
FIG. 1 shows a first embodiment of a musical string in cross section.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

FIGS. 1 to 6 show embodiments of a musical string 1, in particular a musical string of a string instrument, wherein the musical string 1 has at least one load-bearing string core 2, wherein the string core 2 has a predeterminable number of plastic threads, wherein the plastic threads include a first group 3 of first plastic threads and a second group 4 of second plastic threads, wherein the first plastic threads differ from the second plastic threads regarding a predeterminable physical, in particular mechanical, property.

This makes it possible to produce a musical string 1 which has a long service life. This makes it possible to produce a musical string 1 which has a good sound and a good response over a long period of time, in particular when being excited by stroking with a bow. The two groups 3, 4 of plastic threads, which differ regarding their properties, allow balancing out and/or compensating a behavior of one plastic by a behavior of the other plastic. This allows further achieving a particularly balanced sound.

The embodiments shown in FIGS. 1 to 6 are simplified representations. The proportions do not have to correspond to the real proportions. In order to facilitate understanding of the invention individual parts may be shown in strongly enlarged view or significantly overdrawn proportions. Further the individual parts of the shown musical strings 1 are shown directly contacting each other in the views, whereas real musical strings 1 may have parallel distances between the individual parts or at individual points.

A preferred field of application of such musical strings 1 are the instruments of the violin family, i.e., the violin the violin or the viola or viola, the violoncello or cello of the base or contrabass. Further preferred instruments for using the musical strings 1 according to the invention are viola da gamba and viola d'amore. Such musical strings 1 according to the invention can be provided for all bowed string instruments.

Musical strings 1 according to the invention are provided for sound producing oscillations, wherein a particular type of musical string 1 is provided for use in a particular type of musical instrument. The musical strings 1 according to the invention also have a tuning pitch and a so-called tuning weight. The tuning pitch specifies the fundamental tone with which a partial length section of the musical string 1—within the total length of the musical string 1 between its end regions—of the length of the particular type of musical instrument oscillates, when the musical string 1 is impinged with the tuning weight, i.e., tensioned and was excited to oscillate.

Musical strings 1 according to the invention have a string core 2 which is provided and configured to absorb the stress or the tension to which the musical string 1 is subjected in a state in which the musical string is tensioned on the musical instrument.

The present musical string 1 has a substantially circular cylindrical outer contour when the musical string 1 is tensioned.

Musical strings 1 for string instruments for lower tunings usually have windings or at least one winding layer 7 in order to increase the mass layer of the musical string 1. The fundamental frequency with which the musical string 1 oscillates depends on the oscillating length of the corresponding musical string 1, the force with which the respective musical string 1 is tensioned and the mass layer of the musical string 1. Preferably the musical string 1 has at least one first winding layer 7 which has at least one first winding element, wherein the at least one first winding element is helically wound about the string core 2.

According to a particularly preferred embodiment the musical string 1 has a least one further winding layer which is arranged about the first winding layer 7 or between the first winding layer 7 and the string core 2.

Preferably the at least one first winding element of the first winding layer 7 or the further winding element of further winding layers is configured as a band with substantially rectangular cross section and a predeterminable edge shape. It is also possible to arrange multiple bands in the form or a multi-turn helical line in the first winding layer 7. It can also be provided that one or winding elements are configured as round wire.

According to anther advantageous feature of the invention, the at least one round wire or the at least one band is made of at least one material selected from the group of: aluminum, magnesium, chromium, nickel, silicone, silver, gold, platinum, rhodium, copper, tungsten, wherein each of the mentioned materials can be provided as pure material in the technical sense but also as a component of an alloy. Particularly advantageous have proven musical strings 1 in which the at least one round wire or the at least one band is made of a material selected from the group of: steel, aluminum-magnesium alloys, aluminum-magnesium-manganese alloys, silver copper alloys, silver platinum alloys, silver rhodium alloys, silver palladium alloys, iron chromium-nickel-silicone-aluminum alloys.

The string core 2 has a predeterminable plurality of plastic threads. Hereby principally any type of plastic thread can be provided for example including polymer fibers, in particular including polyamides, aramid fibers, PEK, PAEK, PEEK, PBT, polyester, nylon, polyethylene, PET, PEET, PES, PP, POM, PTFE, PVDF, PVDC, HPPE (high performance polyethylene), PA and/or PVC.

The plastic threads of the string core 2 are hereby the supporting elements of the string core 2 and extend substantially in longitudinal direction or along the extent of the musical string 1, wherein the plastic threads can also be wound or stranded together.

According to anther advantageous feature of the invention, the plastic threads of the string core 2 include at least one first group 3 of first plastic threads and a second group 4 of second plastic threads, wherein the first plastic threads differ from the second plastic threads with regard to a predeterminable physical, in particular mechanical, property. The first group 3 and the second group 4 together form the string core 2.

Particularly preferably it is provided that the physical property is a material property.

Hereby it is provided according to a first preferred embodiment of the present invention that the physical material property is a modulus of elasticity, hereinafter referred to a as E-modulus. The first plastic threads have an E-modulus within a first E-modulus region, in particular substantially a first E-modulus, and the second plastic threads have an E-modulus within a second E-modulus range, in particular a second E-modulus. In the elastic expansion processes during the oscillations of a musical string 1 different E-moduli lead to different force distributions and spring stiffnesses inside the string core 2 and to a balanced sound. As a result the static and dynamic friction transitions inside the string core occur over a broader time period and are thus less pronounced.

The E-moduli can be different among different plastic types and also inside the same plastic type.

As an example some typical ranges for E-moduli of some plastic types are stated here: PAEK: 2.2. to 12 GPa, in particular 2.6 to 7.7 GPa; PA: 0.7 to 6 GPa, in particular 3.8 to 5.8 GPa; PE: 43 to 172 GPa, in particular 55 to 81 GPa; PVDF 0.1 to 7 GPa, in particular 2.7 to 5.2 GPa.

Because certain static fluctuations of the E-moduli of the individual plastic threads are expected within the first or second group 3, 4, reference is made respectively to a first or second E-modulus range.

With respect to the pairing of the first plastic threads and the second plastic threads it has proven advantageous when an E-modulus in the first E-modulus range is at least 103% of an E-modulus in the second E-modulus range in order to achieve a corresponding effect by different E-moduli.

With respect to the pairing of the first plastic threads and the second plastic threads it has further proven advantageous when an E-modulus within the first E-modulus range is at most 1750 times, in particular 245 times an E-modulus within the second E-modulus range.

The determination of an E-modulus or elasticity modulus is well known.

According to a second preferred embodiment of the present invention the physical material property is a creep modulus, that the first plastic threads have a creep modulus within a first creep modulus range, in particular substantially a first creep modulus, and that the second plastic threads have a creep modulus within a second creep modulus range, in particular substantially a second creep modulus. Creep means the time-dependent length change of a material under load. The first group 3 and the second group 4 expand differently with persisting load. This leads to a load-time dependent displacement of the stress from one of the at least two groups 3, 4 to the other. As a result in particular the service life of the musical string 1 can be increased.

As a example some typical ranges for creep moduli of some plastic types are stated here: PAEK: 2500 MPa; PA: 700 MPa; PET: about 2000 MPa; PVDF 1750 MPa, PE-HD 400 MPa.

Because within the first or second group 3, 4 certain statistical fluctuations of the creep modulus of the individual plastic threads are expected, the present specification refers respectively to a first or second creep modulus range.

With respect to the pairing of the first plastic threads and the second plastic threads it has proven advantageous when a creep modulus within the first creep modulus range is at least 103% of a creep modulus within the second creep modulus range.

It has also proven advantageous with respect to the pairing of the first plastic threads and the second plastic threads when a creep modulus within the first creep modulus ranges is at most 625% of a creep modulus within the second creep modulus range.

The determination of the creep modulus is performed according to ISO 899-1 (tensile creep modulus 0.5%; 1000 h).

Independent of the creep modulus it is provided according to a third particularly preferred embodiment of the present invention that the first group 3 differs from the second group 4 in that for a first time period of tensioning of the musical string 1 with a predetermined tuning weight up to a first time point substantially the first group 3 carries the tuning weight, and that subsequently substantially the second group 4 caries the tuning weight. Hereby a time-dependent creep behavior as well as a relaxation process may be the cause for the corresponding behavior, which manifests itself in a different time-dependent expansion behavior of the first and second plastic threads.

As a result a string core 2 can be configured so that at a time point at which a conventional musical string 1 would already have reached the end of its life cycle and would be replaced by the musician, the present musical string 1 can still be continued to be used.

Hereby, in particular for determining the behavior or the choice of the first and second plastic threads, it is provided that—when subjected to stress by a tuning weight—the time-dependent length of the first plastic threads and the time-dependent length of the second plastic threads are only the same at the first time point.

Figure 7:
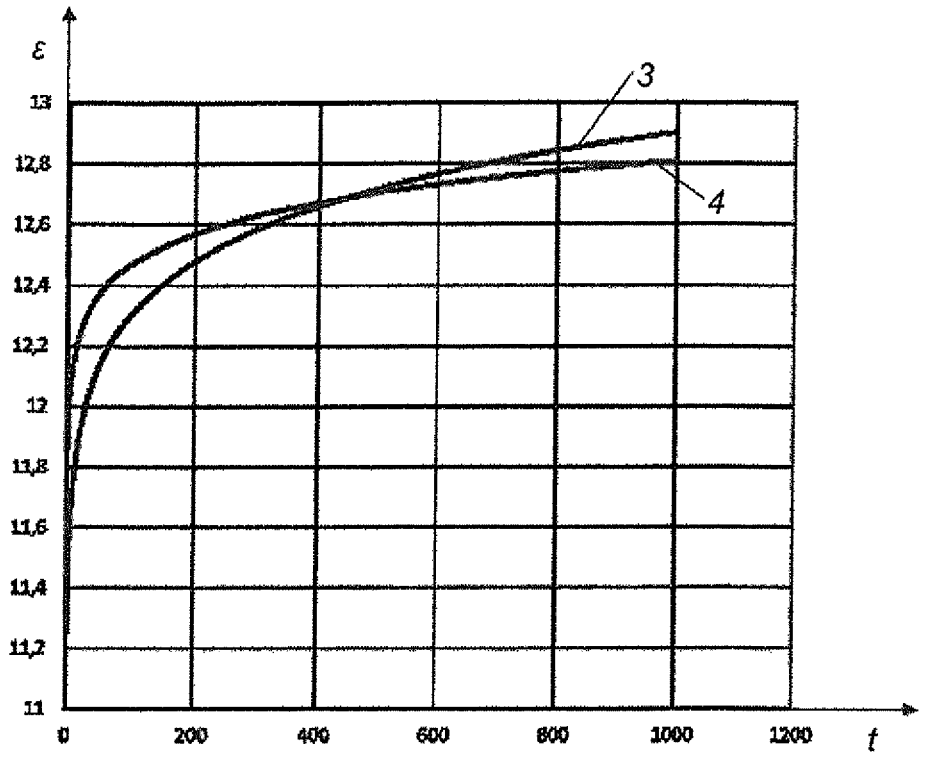
FIG. 7 shows a time/elongation diagram of a plastic of the first group and the second group.

This can be tested in a so-called creep test in which the first and second plastic threads are each subjected to load with a constant weight and their elongation is determined. FIG. 7 shows a diagram of such a creep test. It is noted that this is a static test in which the corresponding plastic thread is not subjected to repeated load changes. The corresponding first time point, which is about at 450 h, is reached earlier in the dynamic stress by playing.

The corresponding behavior can also be described or determined in that a first differential quotient of the time-dependent length change of one of the first plastic threads—determined under predeterminable test conditions—is different from a second differential quotient of the time dependent length change of one of the second plastic threads—determined under the first measuring conditions.

The corresponding behavior can also be described or determined in terms of a force required to maintain the respective thread at a particular length. For example when one of the first plastic threads and one of the second plastic threads are subjected to a persisting load a required first force to keep the first plastic thread at a predeterminable length greater than a predeterminable starting length is greater prior to particular duration of the load than a required second force to hold the second plastic thread at the predeterminable length greater than the predeterminable starting length.

An example for the first time points at static load of some selected pairings of first and second plastic threads are the following values: PVDF to PAEK 372 h; HPPE to PAEK 2339 h; PAEK of a first lot (charge) to PAEK of a second lot 375 h; HPPE to PVDF 3041 h.

In the embodiments of the musical string 1 described above the physical property is a physical material property. As an alternative or in addition it can be provided that the physical property is a thread thickness, that the first plastic threads each have a substantially a first thread thickness an that the second plastic threads have a second thread thickness different form the first thread thickness. Hereby it was shown that as a result of different thread thicknesses a balanced sound can be achieved relative to the same thread thickness as well as that thicker plastic threads over time change their mechanical properties slower than thinner plastic threads.

The individual plastic threads can each have thread strength in the range between 10 dtex and 1300 dtex.

Each plastic thread is made of a predeterminable number of filaments. Hereby it can be provided that the plastic threads are configured as a monofilament, thus including only one filament, or as a multifilament including a predeterminable plurality of filaments.

In addition or as an alternative to the physical properties described above, it can further be provided that the physical property is a filament number, that the first plastic threads each have substantially a first filament number and that the second plastic threads each have substantially a second filament number which is different from the first filament number.

In particular combinations of different filament numbers and thread strength are provided. In the following preferred combinations of thread strength and filament number are described. Hereby the value preceding the "f" indicates the thread strength in dtex and the value after the "f" the filament number:

| | | |
|---|---|---|
| 20 f 1 | 185 f 17 | 200 f 12 |
| 110 f 25 | 185 f 30 | 230 f 30 |
| 150 f 8 | 300 f 12 | 300 f 3 |
| 180 f 1 | 400 f 12 | 400 f 200 |
| 185 f 3 | 200 f 8 | 1000 f 50 |
| 185 f 10 | 200 f 10 | 1100 f 40 |

Preferably it is provided that the first and second plastic threads each are arranged as a part of at least one fiber bundle in the string core 2, wherein preferably a predeterminable plurality of fiber bundles is provided per group 3, 4, 5.

In the following a first number of preferred embodiments of string cores 2 is described:

According to a first preferred embodiment of a string core 2 it is provided that the first group 3 is made of two plastic threads with 200 f 12 with a first E-modulus, and a second group 4 made of four plastic threads with 185 f 30 with a second E-modulus which is different from the first E-modulus.

According to a second preferred embodiment of a string core 2 it is provided that the first group 3 is made of six plastic threads with 150 f 8 with a first E-modulus, and a second group 4 made of four plastic threads with 110 f 25 with a second E-modulus different form the first E-modulus.

According to a third embodiment of a string core 2 it is provide that the first group 3 is made of four plastic threads with 1100 f 40 with a first E-modulus and a second group 4 made of two plastic threads with 200 f 8 with a second E-modulus different form the first E-modulus.

With respect to the total strength of the string core 2 it is preferred, when the latter is between 300 dtex and 12000 dtex.

In the following several further preferred embodiments of the first and second group 3, 4 regarding concrete plastic types are described.

Preferably it is provided that corresponding to the above-described preferred different properties, the first plastic threads are made of a first plastic, that the second plastic threads are made of a second plastic and that the first plastic is a plastic of a first plastic type and that the second plastic is a plastic of a second plastic type different from the first plastic type.

Hereby in particular the following combinations have proven advantageous:

- first plastic threads made of PA and second plastic threads made of PAEK
- first plastic threads made of PVDF and second plastic threads made of PAEK
- first plastic threads made of PA and second plastic threads made of PVDF
- first plastic threads made of PET and second plastic threads made of PAEK
- first plastic threads made of PET and second plastic threads made of PA
- first plastic threads made of PVDF and second plastic threads made of PAEK
- first plastic threads made of HPPE and second plastic threads made of PVDF
- first plastic threads made of HPPE and second plastic threads made of PAEK
- first plastic threads made of PA and second plastic threads made of PAEK
- first plastic threads made of HPPE and second plastic threads made of PA As described above it has been shown that within the same plastic type significant differences of the physical properties may occur. Therefore it is further preferably provided that the first plastic threads are made of a first plastic, that the second plastic threads are made of a second plastic and that the first plastic and the second plastic is a plastic of the same plastic type. Hereby it is of course provided that the two plastics of the same type differ regarding their physical properties.

Hereby in particular the following combinations have proven advantageous:

- first plastic threads and second plastic threads made of PAEK
- first plastic threads and second plastic threads made of PA.

Preferably it is provided that the plastic threads of the string core 2 further include a third group 5 of third plastic threads, wherein the third plastic threads differ from the first plastic threads and the second plastic threads regarding a value of a predeterminable physical, in particular mechanical, property.

It can preferably be provided that the plastic threads of the string core 2 include further corresponding groups of plastic threads, which differ from the plastic threads of the other groups 3, 4 regarding the predeterminable physical, in particular mechanical properties. With respect to the preferred manner of distinction the conditions described with regard to the first and second group 3, 4 apply.

In particular the following combinations have proven advantageous:

- first, second and third plastic threads made of PA
- first and second plastic threads made of PAEK, third plastic threads made of PA.

According to another advantageous feature of the invention, the plastic threads of the string core 2 are wetted with at least one first fluid 6. This allows besides influencing the inner friction, damping and bonding to also influence the age related change of the plastic threads, for example via the degree of the physical and/or chemical interaction of the first fluid with the plastic threads.

It is further preferably provided hat between the string core 2 and the first winding layer 7 at least one further fluid is arranged which allows further influencing the damping and bonding.

The first and/or second fluid hereby preferably includes wax, in particular natural waxes, such as bees wax or carnauba wax, and/or synthetic waxes such as polyolefin waxes, paraffin oil, for example fatty oils, mineral oils and/or synthetic oils, resin, in particular natural resin, for example larch resin and/or spruce resin, and/or synthetic resins for example polyester resin, phenol resin and/or epoxy resin, wherein further additives may be provided for example metal powder.

The at least two groups 3, 4 can be arranged differently in the string core 2. FIGS. 1-6 each show different embodiments of a musical string 1 which each have a differently configured string core 2 and a first winding layer 7.

The musical string 1 according to FIG. 1 has a string core 2 in which the first and second plastic threads are mixed. The first and second plastic threads can hereby be mixed uniformly. However it can also be provided that the first plastic threads are distributed bell-shaped in the second plastic threads or are arranged mixed with the second plastic threads. Hereby the first plastic threads are then present at a higher concentration in the center of the string core 2 than in the border regions of the string core which is substantially formed by second plastic threads.

Figure 2:
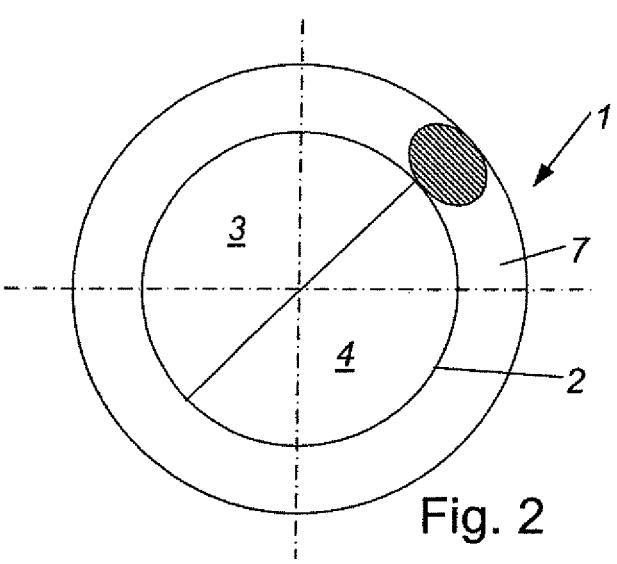
FIG. 2 shows a second embodiment of a musical string in cross section.

The musical string 1 according to FIG. 2 has a string core 2 in which the first group 3 and the second group 4 each occupy a semicircular area of the string core cross section.

Figure 3:
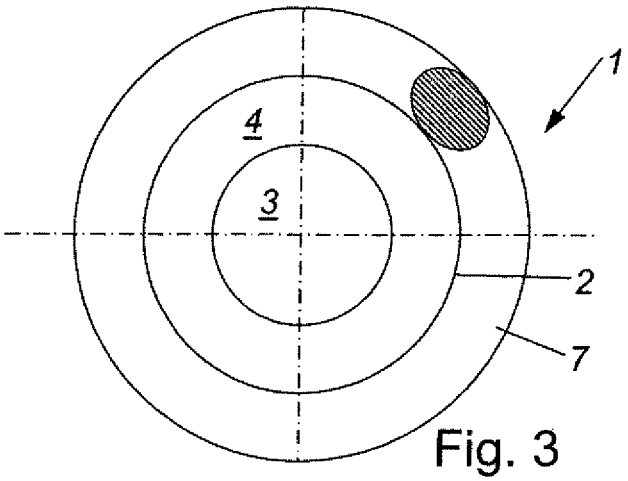
FIG. 3 shows a third embodiment of a musical string in cross section.

The musical string 1 according to FIG. 3 has a string core 2 in which the first group 3 is arranged as a full circular area inside the ring shaped second group 4.

Figure 4:
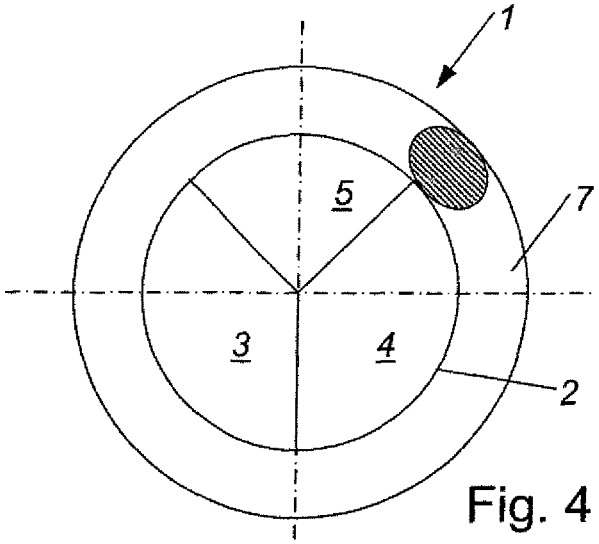
FIG. 4 shows a fourth embodiment of a musical string in cross section.

The musical string 1 according to FIG. 4 has a string core 2 in which a first, a second and a third group 3, 4, 5 are each arranged in the manner of a circular segment.

Figure 5:
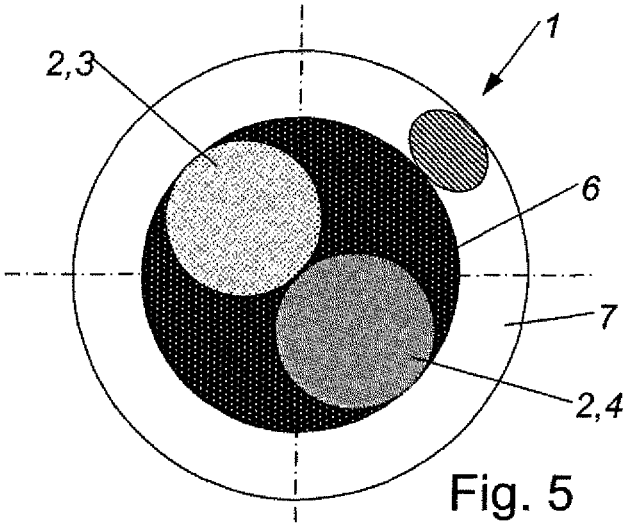
FIG. 5 shows a fifth embodiment of a musical string in cross section.

The musical string 1 according to FIG. 5 has a string core 2 in which the first group 3 and the second group 4 each have a circular area cross section and are arranged adjacent each other and preferably twisted with each other. The first group 3 and the second group 4 are surrounded by a first fluid 6.

Figure 6:
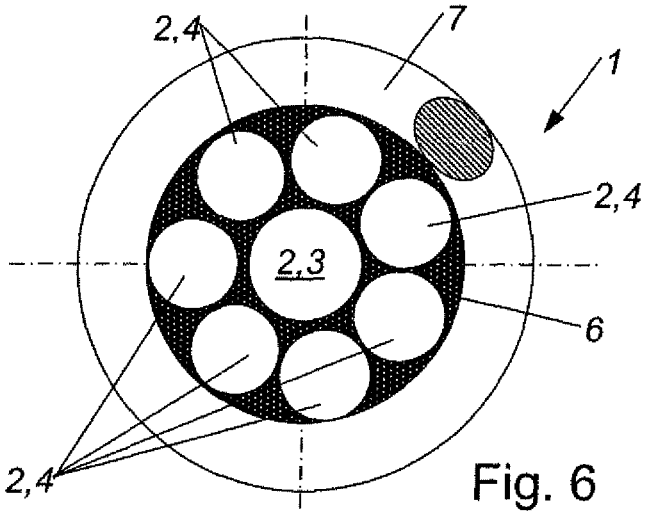
FIG. 6 shows a sixth embodiment of a musical string in cross section.

The musical string 1 according to FIG. 6 has a string core 2 in which the first group 3 is formed by a thread with a circular cross section, which is surrounded by seven threads, each belong to the second group 4 and having a circular cross section.

The first, second and third groups 3, 4, 5 or plastic threads are preferably interchangeable corresponding to the description with regard to the physical properties.

According to anther advantageous feature of the invention, one of the groups 3, 4, 5 or the plastic threads of one of the groups 3, 4, 5 make up at least 1% of the mass of all plastic threads and/or the total cross sectional surface of all plastic threads of the string core 2. Particularly preferably it is hereby provided that one of the groups 3, 4, 5 or the plastic threads of one of the groups make up substantially 10%, 20%, 30% or 40% or 50% or 60% or 70% or 80% or 90% or 99% of the mass of all plastic threads and/or the total cross sectional surface of all plastic threads of the string core 2.

What is claimed as new and desired to be protected by Letters Patent is set forth in the appended claims and includes equivalents of the elements recited therein.

What is claimed is:

1. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical material property, wherein the physical material property is an E-modulus, wherein the first plastic threads have an E-modulus within a first E-modulus range, and wherein the second plastic threads have an E-modulus within a second E-modulus range.

2. The musical string of claim 1, wherein an E-modulus within the first E-modulus range is at least 103% of an E-modulus within the second E-modulus range.

3. The musical string of claim 1, wherein an E-modulus within the first E-modulus range is at most 1750 times an E-modulus within the second E-modulus range.

4. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical material property, wherein the physical material property is a creep modulus, wherein the first plastic threads have a creep modulus within a first creep modulus range, and wherein the second plastic threads have a creep modulus within a second creep modulus range.

5. The musical string of claim 4, wherein a creep modulus within the first creep modulus range is at least 103% of a creep modulus within the second creep modulus range.

6. The musical string of claim 4, wherein a creep modulus within the first creep modulus range is at most 625% of a creep modulus within the second creep modulus range.

7. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical property, wherein the first group differs from the second group so that for a first time period of tensioning the musical string with a predetermined tuning weight up to a first time point the first group substantially carries the tuning weight and that subsequent to the first time point the second group substantially carries the tuning weight.

8. The musical string of claim 7, wherein—in a time-dependent length of one of the first plastic threads and a time dependent length of one of the second plastic threads are only the same at the first time point.

9. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical property, wherein the physical property is a thread strength, wherein the first plastic threads each substantially have a first thread strength, and wherein the second plastic threads each substantially have a second thread strength.

10. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical property, wherein the first plastic threads are made of a first plastic, wherein the second plastic threads are made of a second plastic, and wherein the first plastic is a plastic of a first plastic type and the second plastic is a plastic of a second plastic type different from the first plastic type.

11. The musical string of claim 10, wherein the first plastic threads are made of PA and the second plastic threads are made of PAEK.

12. The musical string of claim 10, wherein the first plastic threads are made of PVDF and the second plastic threads are made of PAEK.

13. The musical string of claim 10, wherein the first plastic threads are made of PA and the second plastic threads are made of PVDF.

14. The musical string of claim 10, wherein the first plastic threads are made of PET and the second plastic threads are made of PAEK.

15. The musical string of claim 10, wherein the first plastic threads are made of PET and the second plastic threads are made of PA.

16. The musical string of claim 10, wherein the first plastic threads are made of PVDF and the second plastic threads are made of PET.

17. The musical string of claim 10, wherein the first plastic threads are made of HPPE and the second plastic threads are made of PAEK.

18. The musical string of claim 10, wherein the first plastic threads are made of HPPE and the second plastic threads are made of PVDF.

19. The musical string of claim 10, wherein the first plastic threads are made of HPPE and the second plastic threads are made of PA.

20. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical property, wherein the first plastic threads are made of a first plastic, wherein the second plastic threads are made of a second plastic, and wherein the first plastic and the second plastic are a plastic of the same type.

21. The musical string of claim 20, wherein the first plastic threads and the second plastic threads are made of PAEK.

22. The musical string of claim 20, wherein the first plastic threads and the second plastic threads are made of PA.

23. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical property, wherein the plastic threads further include a third group of third plastic threads, wherein the third plastic threads differ from the first plastic threads and the second plastic threads regarding a value of a predeterminable physical property.

24. The musical string of claim 23, wherein the physical property is a mechanical property.

25. The musical string of claim 23, wherein the first plastic threads, the second plastic threads and the third plastic threads are made of PA.

26. The musical string of claim 23, wherein the first plastic threads and the second plastic threads are made of PAEK and wherein the third plastic threads are made of PA.

27. A musical string, comprising:

at least one load-bearing string core, said string core having plastic threads, said plastic threads including a first group of first plastic threads and a second group of second plastic threads, wherein the first plastic threads differ from the second plastic threads with respect to a predeterminable physical property, and at least one first fluid wetting the plastic threads of the string core.

28. The musical string of claim 1, further comprising at least one winding layer, arranged about the string core.

29. The musical string of claim 27, further comprising at least a second fluid arranged between the string core and the first winding layer.

30. The musical string of claim 1, wherein an E-modulus within the first E-modulus range is 245 times an E-modulus within the second E-modulus range.

31. The musical string of claim 4, further comprising at least one winding layer, arranged about the string core.

32. The musical string of claim 7, further comprising at least one winding layer, arranged about the string core.

33. The musical string of claim 9, further comprising at least one winding layer, arranged about the string core.

34. The musical string of claim 10, further comprising at least one winding layer, arranged about the string core.

35. The musical string of claim 20, further comprising at least one winding layer, arranged about the string core.

36. The musical string of claim 23, further comprising at least one winding layer, arranged about the string core.

37. The musical string of claim 27, further comprising at least one winding layer, arranged about the string core.

* * * * *